US012123191B2

(12) United States Patent
Lee

(10) Patent No.: US 12,123,191 B2
(45) Date of Patent: Oct. 22, 2024

(54) STEEL PLATE BUILT-UP BEAM FOR STEEL-CONCRETE COMPOSITE BEAM

(71) Applicant: SENVEX CO., LTD., Seoul (KR)

(72) Inventor: Chang Nam Lee, Seoul (KR)

(73) Assignee: SENVEX CO., LTD., Seoul (KR)

( * ) Notice: Subject to any disclaimer, the term of this patent is extended or adjusted under 35 U.S.C. 154(b) by 129 days.

(21) Appl. No.: 17/789,811

(22) PCT Filed: Dec. 23, 2020

(86) PCT No.: PCT/KR2020/018983
§ 371 (c)(1),
(2) Date: Jun. 29, 2022

(87) PCT Pub. No.: WO2021/141297
PCT Pub. Date: Jul. 15, 2021

(65) Prior Publication Data

US 2023/0037589 A1 Feb. 9, 2023

(30) Foreign Application Priority Data

Jan. 8, 2020 (KR) ..... 10-2020-0002518

(51) Int. Cl.
*E04C 3/293* (2006.01)
*E04C 3/07* (2006.01)
*E04C 3/04* (2006.01)

(52) U.S. Cl.
CPC ..... *E04C 3/293* (2013.01); *E04C 3/07* (2013.01); *E04C 2003/0413* (2013.01); *E04C 2003/0473* (2013.01)

(58) Field of Classification Search
CPC .... E04C 3/07; E04C 3/293; E04C 2003/0413; E04C 2003/0473; E04C 5/0604
See application file for complete search history.

(56) References Cited

U.S. PATENT DOCUMENTS 6,807,789 B1 * 10/2004 Kim ..... E04C 3/294 52/847
10,597,864 B1 * 3/2020 Pearson ..... E04B 5/40
10,718,094 B1 * 7/2020 Nelson ..... E04B 5/29
(Continued)

FOREIGN PATENT DOCUMENTS

CN 203066351 U 7/2013
CN 107460993 A * 12/2017 ..... E04C 3/20
(Continued)

OTHER PUBLICATIONS

International Search Report for PCT/KR2020/018983 mailed Mar. 30, 2021 from Korean Intellectual Property Office.

*Primary Examiner* — Jessie T Fonseca
(74) *Attorney, Agent, or Firm* — Revolution IP, PLLC

(57) ABSTRACT

A steel plate built-up beam for a steel-concrete composite beam, which is for the purpose of forming a steel-concrete composite beam by filing the inside thereof with concrete, includes: a pair of web plates spaced apart from each other; a lower flange provided on the lower portions of the web plates so as to connect the lower portions of the pair of web plates; and upper angles provided on the upper portions of the web plates, respectively, such that one leg of the upper angle is coupled to side surfaces of the web plates, and other leg of the upper angle is formed to bend in directions perpendicular to the web plates.

1 Claim, 9 Drawing Sheets

(56) References Cited

U.S. PATENT DOCUMENTS

| | | | | |
|---|---|---|---|---|
| 2002/0069598 | A1* | 6/2002 | Rahimzadeh | E04B 5/29 52/236.7 |
| 2011/0247297 | A1* | 10/2011 | Bae | E04C 3/291 52/846 |

FOREIGN PATENT DOCUMENTS

| | | | | | |
|---|---|---|---|---|---|
| CN | 107471423 | A | * | 12/2017 | |
| CN | 207686134 | U | * | 8/2018 | |
| EP | 1507938 | B1 | | 3/2010 | |
| KR | 20080099753 | A | * | 11/2008 | |
| KR | 10-2013-0043324 | A | | 4/2013 | |
| KR | 20130043324 | A | * | 4/2013 | |
| KR | 101512944 | B1 | * | 4/2015 | |
| KR | 10-2016-0032891 | A | | 3/2016 | |
| KR | 20160032891 | A | * | 3/2016 | |
| KR | 10-2019-0119265 | A | | 10/2019 | |
| KR | 20190115814 | A | * | 10/2019 | |
| KR | 102325067 | B1 | * | 11/2021 | |
| WO | WO-9004690 | A | * | 5/1990 | E04B 5/10 |

* cited by examiner

STEEL PLATE BUILT-UP BEAM FOR STEEL-CONCRETE COMPOSITE BEAM

TECHNICAL FIELD

The present invention relates to a steel plate built-up beam for a steel-concrete composite beam, wherein one leg of an upper angle is coupled to an upper portion of a side of each of a pair of web plates spaced apart from each other, and more specifically, to a steel plate built-up beam for a steel-concrete composite beam, which can minimize welding during manufacturing and freely set the thickness of the upper angle, thereby having excellent sectional efficiency.

BACKGROUND ART

A TSC composite beam capable of enhancing sectional efficiency by filling the inside of a steel plate having an open upper portion with concrete to integrate the steel plate with a slab has been developed and used in construction of a concrete beam.

The TSC composite beam can relatively reduce the amount of steel bones and reduce a construction period by omitting a temporary construction process for installing a mold. In addition, compared with a conventional composite beam, the TSC composite beam can have a desired width of the beam through cold forming, can freely set a steel grade and a thickness of a lower flange, and can freely arrange the number of steel wires or bolts.

As illustrated in FIG. 1, the TSC composite beam includes a U-shaped steel plate having an open upper portion, and an upper flange 230, which is bent inward or outward and is formed on the upper end thereof.

The upper flange 230 may be integrally formed by a web plate 210 of which the upper end is bent. However, in a case in which the thickness of the upper flange 230 and the thickness of the web plate 210 are different from each other as a result of a structural calculation, members must be manufactured based on the thicker part, and thus, the amount of steel materials may be consumed excessively.

Alternatively, as illustrated in FIG. 2, a TSC beam having a built-up section has an upper flange which is manufactured separately, and so, the upper flange is welded and combined with the upper end of a web plate 210.

However, the combination of the upper flange 230 and the web plate 210 requires a great deal of manufacturing period of time since requiring a welding inspection even if the upper flange 230 and the web plate 210 are automatically welded. Additionally, there is a concern for deformation of the members due to welding heat.

DISCLOSURE

Technical Problem

Accordingly, the present invention has been made in view of the above-mentioned problems occurring in the related art, and it is an object of the present invention to provide a steel plate built-up beam for a steel-concrete composite beam, which has excellent structural performance while minimizing a welding process when a steel plate built-up beam is manufactured for forming a steel-concrete composite beam by filling the inside with steel-concrete.

Technical Solution

To accomplish the above-mentioned objects, according to the present invention, there is provided a steel plate built-up beam for forming a steel-concrete composite beam by being filled with concrete, the steel plate built-up beam including: a pair of web plates spaced apart from each other; a lower flange provided at a lower portion of the web plate to connect lower portions of a pair of web plates; and upper angles provided on upper portions of the web plates, wherein one leg of the upper angle is coupled to the side surface of each web plate and the other leg of the upper angle is bent at right angles to the web plate.

According to another preferred embodiment of the present invention, one leg of the upper angle is coupled to a web plate by coupling bolts.

According to another preferred embodiment of the present invention, at least one of the coupling bolts is a through bolt passing through both web plates.

According to another preferred embodiment of the present invention, the one leg of the upper angle is coupled to an inner surface of a web plate.

According to another preferred embodiment of the present invention, the other leg of the upper angle is disposed at the top of the web plate.

Advantageous Effects

The present invention has the following advantages.

First, in a case in which a steel plate built-up beam for forming a steel-concrete composite beam by being filled with concrete is manufactured, the steel plate built-up beam includes upper angles each having one leg coupled to an upper portion of the side surface of each of a pair of web plates, which are spaced apart from each other. Therefore, the steel plate built-up beam according to the present invention can maximize sectional efficiency since the thickness of the upper angle can be set independently from the web plate.

Second, the steel plate built-up beam according to the present invention can have the other leg which is narrower than that of the conventional TSC beam since the entire section of the upper angle, which is a steel section, serves as an upper flange. Therefore, the steel plate built-up beam according to the present invention can maximize the space between both upper angles, so that it is easy to pour concrete thereinto.

Third, when one leg of the upper angle and the web plate are coupled to each other by the coupling bolt, the steel plate built-up beam according to the present invention can reduce the manufacturing period of time due to minimization of welding work and prevent members from being deformed by welding heat.

BEST MODE

In order to achieve the above object, the present invention relates to a steel plate built-up beam for forming a steel-concrete composite beam by being filled with concrete. The steel-concrete composite beam according to an embodiment of the present invention includes: a pair of web plates spaced apart from each other; a lower flange provided at a lower portion of the web plate to connect lower portions of a pair of web plates; and upper angles provided on upper portions of the web plates, wherein one leg of the upper angle is coupled to the side surface of each web plate and the other leg of the upper angle is bent at right angles to the web plate.

MODE FOR INVENTION

Hereinafter, the present invention will be described in detail with reference to the accompanying drawings and the preferred embodiment.

Figure 1:
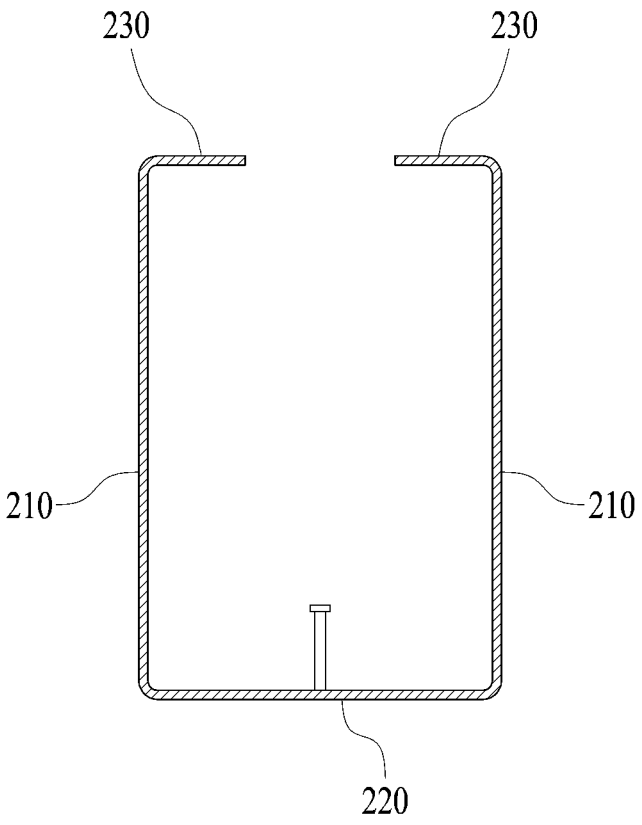
FIG. 1 is a sectional view illustrating a bent type TSC beam.
Figure 2:
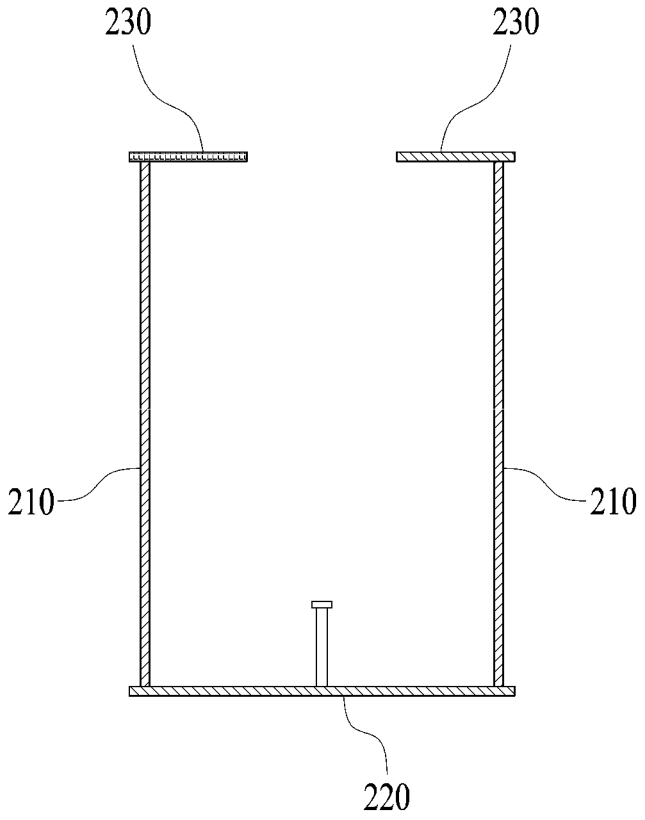
FIG. 2 is a sectional view illustrating a built-up type TSC beam.
Figure 3:
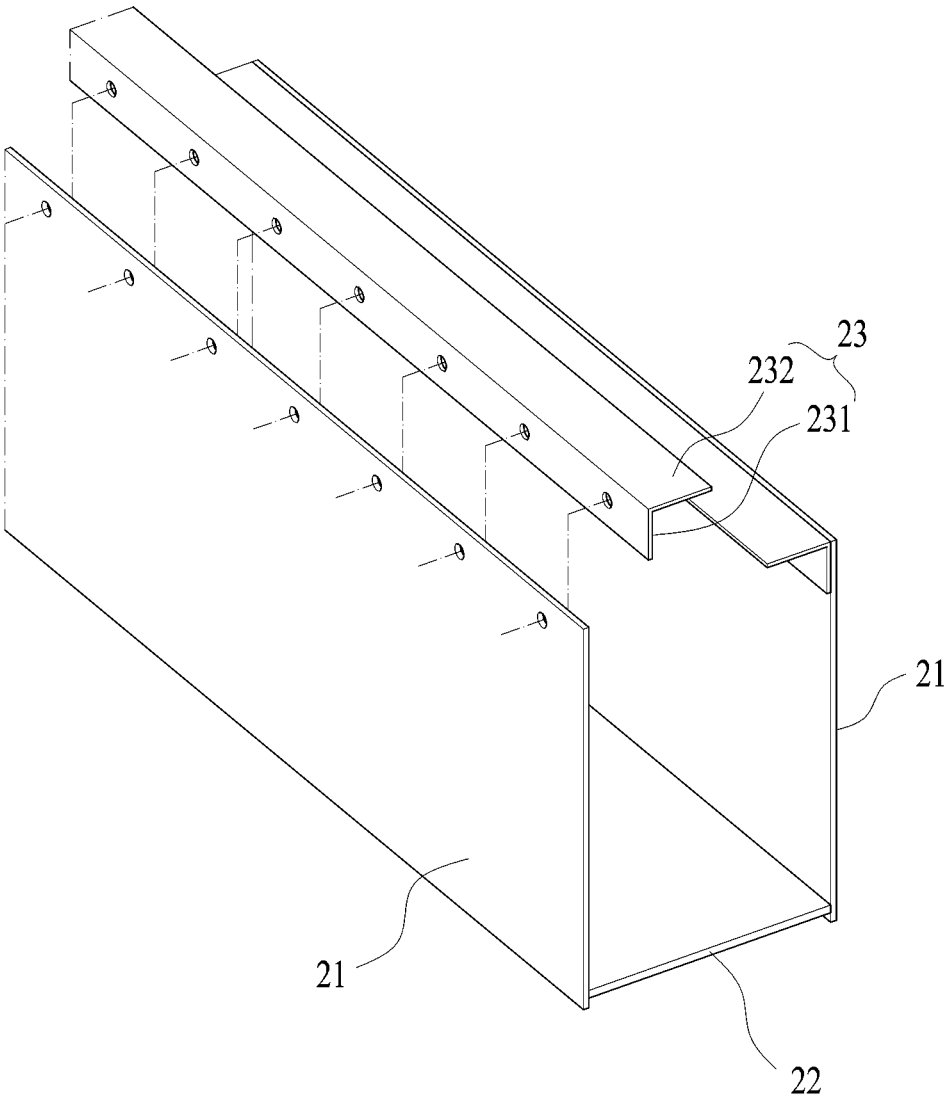
FIG. 3 is a perspective view illustrating the coupling details of a steel plate built-up beam for a steel-concrete composite beam according to the present invention.
Figure 4:
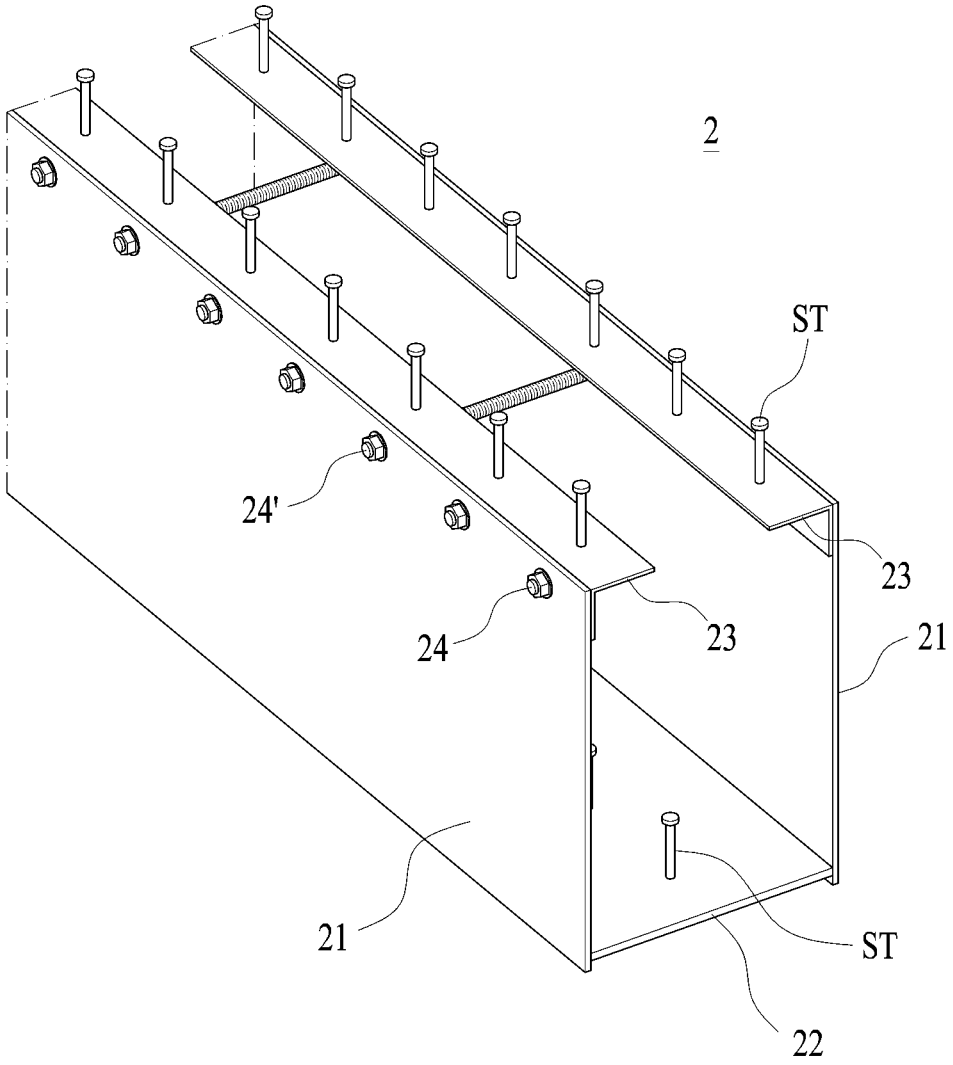
FIG. 4 is a perspective view illustrating a steel plate built-up beam for a steel-concrete composite beam according to an embodiment of the present invention.
Figure 5:
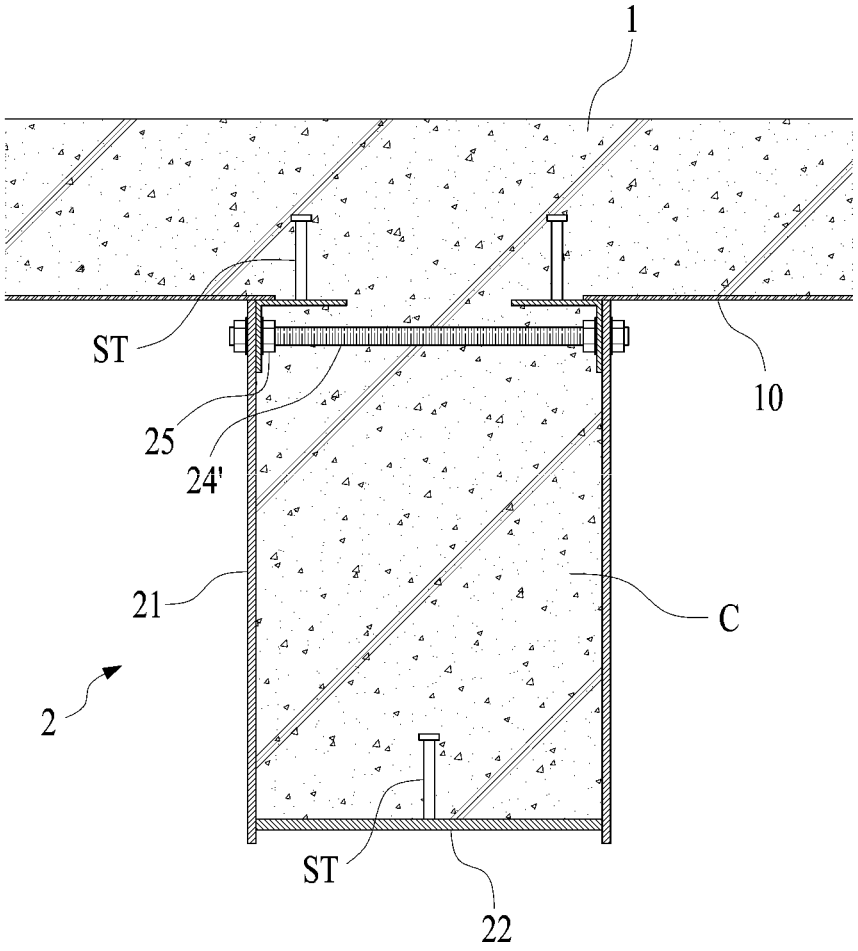
FIG. 5 is a sectional view illustrating a steel-concrete composite beam using the steel plate built-up beam of FIG. 4.

FIG. 3 is a perspective view illustrating the coupling details of a steel plate built-up beam for a steel-concrete composite beam according to the present invention, FIG. 4 is a perspective view illustrating a steel plate built-up beam for a steel-concrete composite beam according to an embodiment of the present invention, and FIG. 5 is a sectional view illustrating a steel-concrete composite beam using the steel plate built-up beam of FIG. 4.

Figure 6:
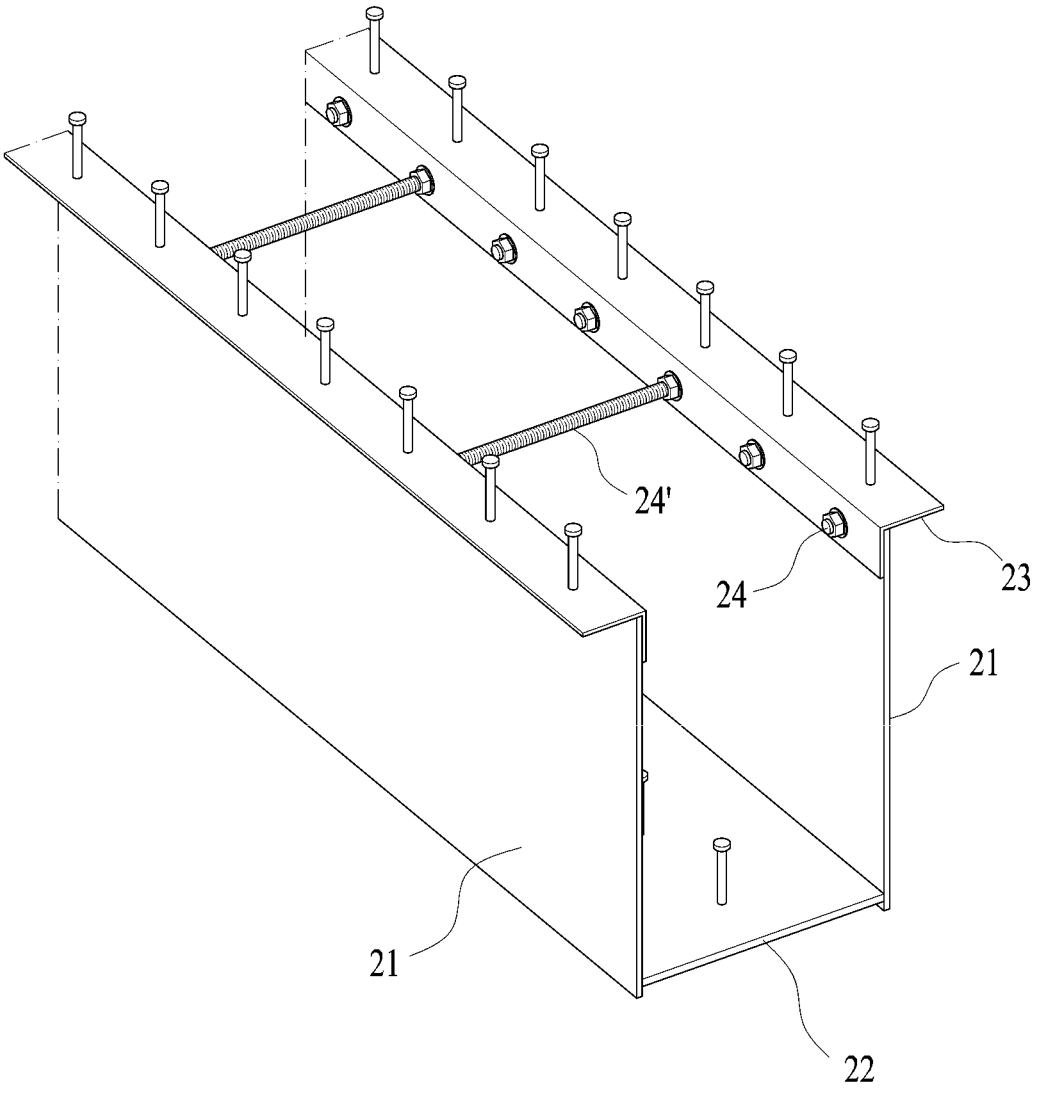
FIG. 6 is a perspective view illustrating a steel plate built-up beam for a steel-concrete composite beam according to another embodiment of the present invention.
Figure 7:
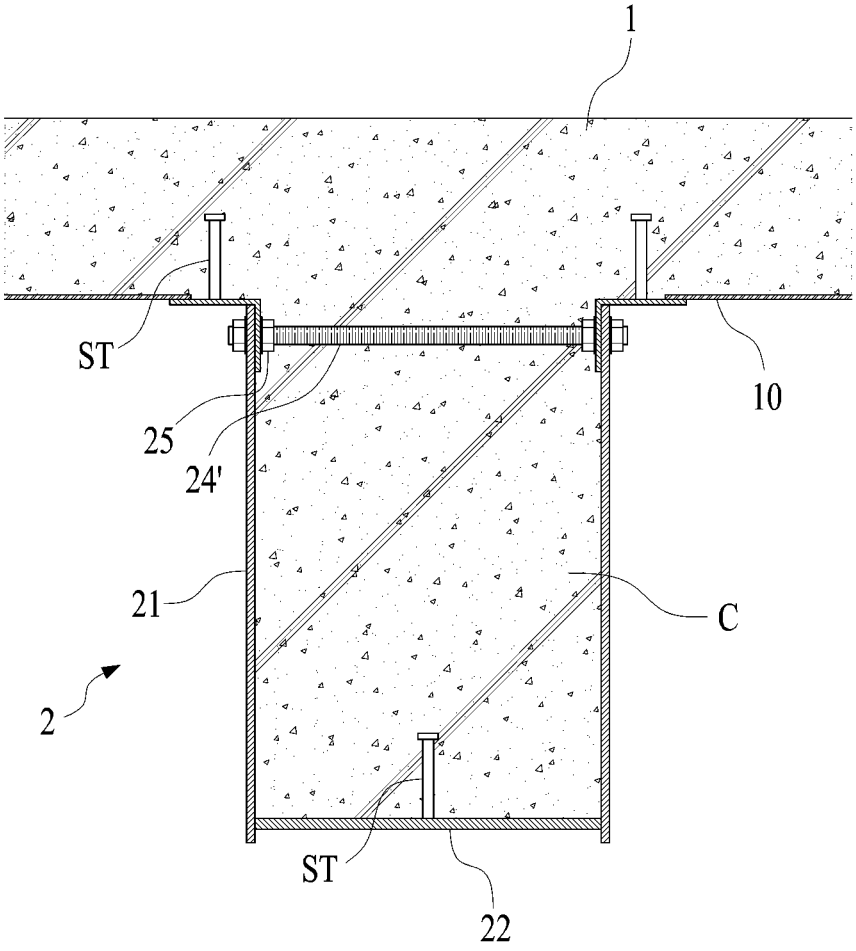
FIG. 7 is a sectional view illustrating a steel-concrete composite beam using the steel plate built-up beam of FIG. 6.

Moreover, FIG. 6 is a perspective view illustrating a steel plate built-up beam for a steel-concrete composite beam according to another embodiment of the present invention, and FIG. 7 is a sectional view illustrating a steel-concrete composite beam using the steel plate built-up beam of FIG. 6.

Figure 8:
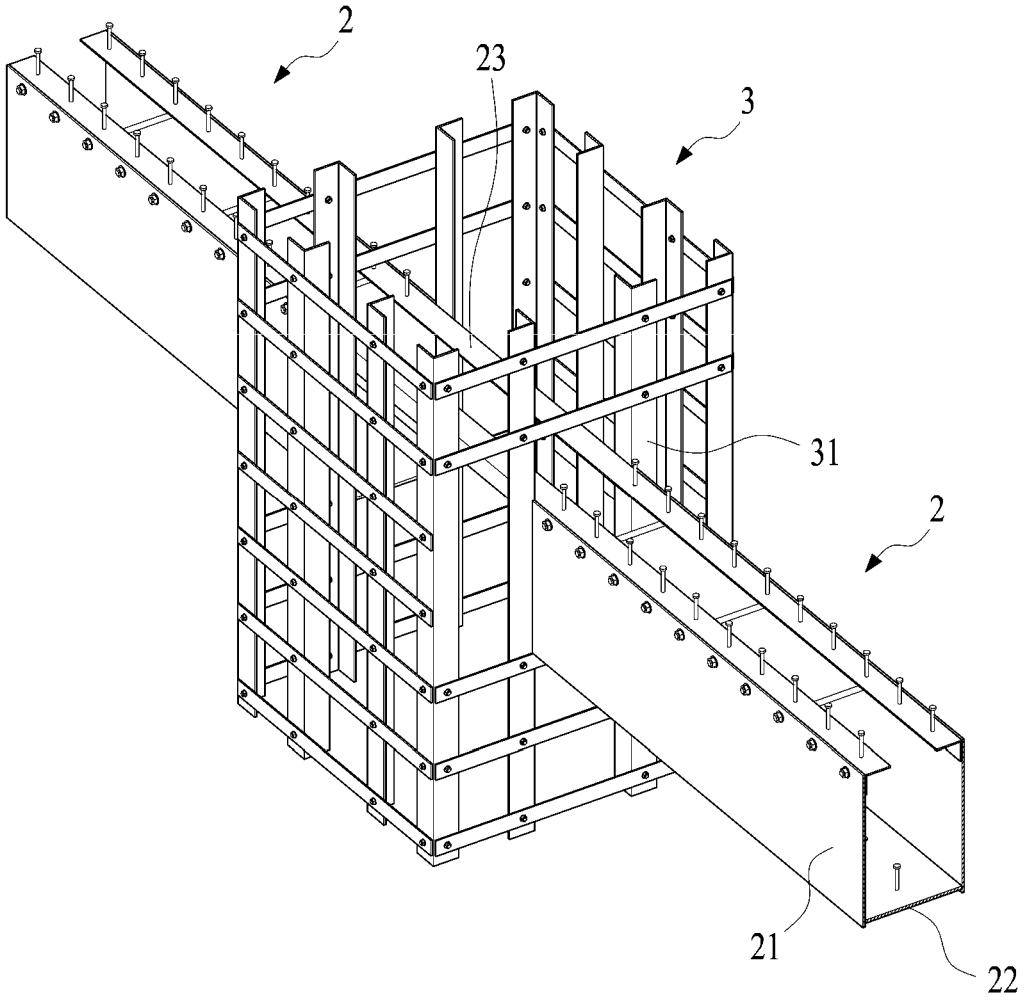
FIG. 8 is a perspective view illustrating a coupling state of a prefabricated steel reinforced concrete (PSRC) column and the steel plate built-up beam.
Figure 9:
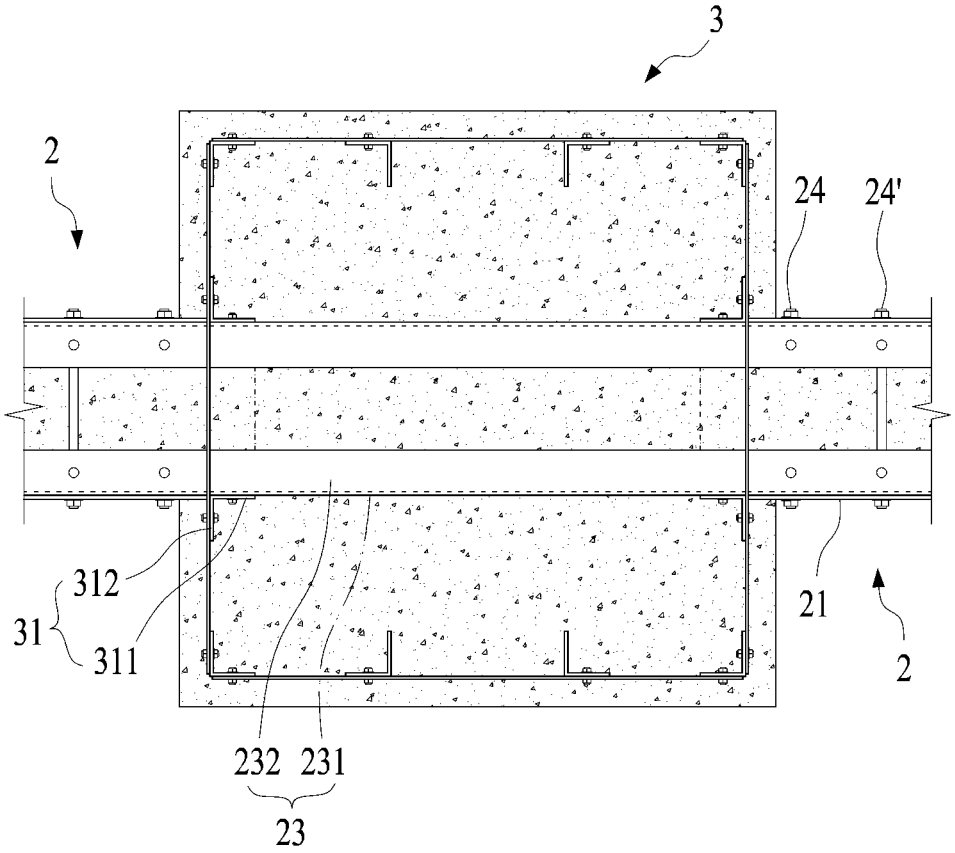
FIG. 9 is a plan sectional view illustrating the prefabricated steel reinforced concrete (PSRC) column and the steel plate built-up beam of FIG. 8.

Furthermore, FIG. 8 is a perspective view illustrating a coupling state of a prefabricated steel reinforced concrete (PSRC) column and the steel plate built-up beam, and FIG. 9 is a plan sectional view illustrating the prefabricated steel reinforced concrete (PSRC) column and the steel plate built-up beam of FIG. 8.

As illustrated in FIGS. 3 to 5, the steel plate built-up beam for a steel-concrete composite beam according to the present invention is to form a steel-concrete composite beam by being filled with concrete C. The steel-concrete composite beam according to an embodiment of the present invention includes: a pair of web plates 21 spaced apart from each other; a lower flange 22 provided at a lower portion of the web plate 21 to connect lower portions of a pair of web plates 21; and upper angles 23 provided on upper portions of the web plates 21, wherein one leg 231 of the upper angle is coupled to the side surface of each web plate 21 and the other leg 232 of the upper angle is bent at right angles to the web plate 21.

The present invention is to provide a steel plate built-up beam for a steel-concrete composite beam, which has excellent structural performance while minimizing a welding process when a steel plate built-up beam is manufactured for forming a steel-concrete composite beam by filling the inside with concrete C.

The a steel plate built-up beam 2 for a steel-concrete composite beam according to the present invention includes web plates 21, a lower flange 22, and upper angles 23.

A pair of the web plates 21 are arranged at the right and left sides to be spaced apart from each other.

The web plates 21 serve as struts of the existing RC beam so as to support shearing force acting the beams.

The lower flange 22 is disposed at the lower portions of the web plates 21 to connect the lower portions of a pair of the web plates 21.

The lower flange 22 serves as a lower reinforcement of the RC beam.

The lower flange 22 may be bent to be extended integrally from the web plates 21.

Additionally, as illustrated in FIG. 3, the lower flange 22 may have a separate steel plate which will be welded to the web plate 21. In this instance, the thickness of the web plate 21 may be different from that of the lower flange 22, thereby maximizing sectional efficiency. That is, the lower flange 22 mainly resisting against bending of the beam is made thick, but the web plate 21 for simply supporting shearing force is made relatively thin.

As illustrated in FIG. 3, in a case in which the lower flange 22 is welded to the inside of the lower end of the web plate 21, since there is no portion protruding outward from the web plate 21, it can fundamentally block accumulation of dust on the members.

Stud bolts ST for integration with concrete C may be coupled on the upper surface of the lower flange 22 (see FIG. 4).

The upper angle 23 is provided on an upper portion of each web plate 21.

The upper angle 23 serves as an upper flange, and is coupled to an upper side surface of the web plate 21.

One leg 231 of the upper angle 23 is coupled to a side surface of the web plate 21, and the other leg 232 is bent at right angles to the web plate 21.

Unlike the conventional TSC beam supporting a tensile force acting on the upper portion of the beam by the bending moment in a negative moment section just by the plate-shaped upper flange, the present invention supports a tensile force by the upper angle 23 which is a section steel material.

Therefore, since the entire cross section of one leg 231 and the other side leg 232 of the upper angle 23 serves as an upper flange, based on the same structural performance, the other leg 232 may be narrower than the upper flange of the conventional TSC beam. That is, since a space between the both upper angles 23 can be secured as much as possible, it is easy to pour concrete C in the space.

The length of one leg 231 of the upper angle 23 is enough for coupling with the web plate 21. In addition, since the other leg 232 of the upper angle 23 has a greater effect on the cross-sectional coefficient, it is preferable that the upper angle 23 is a scalene angle of which the other leg 232 is longer than the one leg 231.

The other leg 232 of the upper angle 23 may be provided to face the outside or the inside of the web plate 21.

In particular, in a case in which the steel plate built-up beam 2 of the present invention is coupled to the PSRC column 3 in which a ㄱ-shaped section steel 31 is disposed, when the other leg 232 of the upper angle 23 is disposed to face the inside of the web plate 21, it is easy to directly attach the upper angle 23 to the ㄱ-shaped section steel 31 of the PSRC column 3.

That is, as illustrated in FIGS. 8 and 9, the one leg 311 of the upper angle 23 gets in close contact with one leg 311 of the ㄱ-shaped section steel 31 of the PSRC column 3 to be fixed by a bolt or the like. At this time, the upper angle 23 is configured to pass through the PSRC column 3 to deliver the upper negative moment of the beam.

The upper angle 23 is excellent at cross-sectional efficiency since being set independently in thickness from the web plate 21.

Meanwhile, a mold such as a deck plate 10 for pouring slab concrete may be mounted on the upper surface of the other leg 232 of the upper angle 23 (FIGS. 5 and 7).

Moreover, stud bolts or the like may be coupled to the upper surface of the other leg 232 of the upper angle 23 to be integrated with the slab concrete.

As illustrated in FIGS. 4 and 5, one leg 231 of the upper angle 23 may be coupled to the web plate 21 by coupling bolts 24.

In this case, the steel plate built-up beam according to the present invention can reduce the manufacturing period of time by minimizing the welding work, and prevent deformation of members due to welding heat.

The coupling bolts 24 or nuts 25 fastened to the coupling bolts 24 are embedded in the concrete C poured in the steel plate built-up beam 2 to serve as a shear connector, thereby integrating the steel plate built-up beam 2 and the concrete C.

A plurality of through-holes for penetration of the coupling bolts 24 can be formed at positions corresponding to each other on the web plate 21 and the one leg 231 of the upper angle 23.

As illustrated in FIGS. 4 and 5, one or more of the coupling bolts 24 may be through bolts 24' passing through the web plates 21.

The coupling bolts 24 for fixing the upper angle 23 to the web plate 21 are through bolts 24', which are long bolts, to fix both upper angles 23 at the same time.

In addition, the through bolts 24' prevent the steel plate built-up beam 2 from being widened with respect to the concrete side pressure. Therefore, foam ties are not necessary.

The through bolts 24' are mounted to pass through all of the left and right web plates 21, and the inner and outer sides of the one leg 231 of each upper angle 23 and the web plate 21 are fastened by the nuts 25.

As illustrated in FIGS. 5 and 7, the one leg 231 of the upper angle 23 may be coupled to the inner surface of the web plate 21.

In this case, since the one leg 231 of the upper angle 23 is not exposed to the outside of the web plate 21, it is easy to finish the exterior.

Furthermore, when the one leg 231 of the upper angle 23 is coupled to the outer surface of the web plate 21, concrete paste leaks between the web plate 21 and the one leg 231 of the upper angle 23 so that the web plate 21 may be contaminated. Accordingly, the one leg 231 of the upper angle 23 is coupled to the inner side of the web plate 21 so that the joining surface of these members is positioned inside the steel plate built-up beam 2.

Accordingly, when the other leg 232 of the upper angle 23 is bent inward or outward from the web plate 21, it is possible to prevent the concrete paste from leaking to the outer surface of the web plate 21 through the paste bonding surface.

As illustrated in FIGS. 3 to 5, the other leg 232 of the upper angle 23 can be formed at the top of the web plate 21.

When the top of the web plate 21 is level with the upper angle 23, the web plate 21 and the upper angle 23 can stably support the deck plate 10 at the same time.

In the positive moment section, a large compressive force is generated on the upper portion of the cross section. Since the one leg 231 of the upper angle 23 gets in close contact with the side surface of the web plate 21 to support the web plate 21, thereby preventing plate buckling of the upper end of the web plate 21.

INDUSTRIAL APPLICABILITY

The steel plate built-up beam for a steel-concrete composite beam according to the present invention includes the upper angles in each of which one leg is coupled to the side surface of each of a pair of web plates spaced apart from each other, there by minimizing welding during manufacturing and freely setting the thickness of the upper angle so as to maximize sectional efficiency. In addition, since the space between both upper angles is maximally secured, it is easy to pour concrete therein.

The invention claimed is:

1. A steel plate built-up beam for forming a steel-concrete composite beam by being filled with concrete (c), the steel plate built-up beam comprising:

a pair of web plates (21), each web plate being spaced apart from each other, wherein each web plate is a flat plate without horizontally bent flanges at both top and bottom;

a lower flange (22) located at an inner surface of a lower portion of each web plate (21), and connecting the lower portion of each web plate (21) without protruding to an outside of each web plate (21), wherein the lower flange (22) is coupled to an inner surface of the lower portion of each web plate (21); and a couple of upper angles (23), each upper angle provided on an upper portion of each web plate (21), comprising:

a first leg (231) which is attached to the inner surface of each web plate (21) using a plurality of coupling bolts (24), and a second leg (232) which is bent in a direction orthogonal to each web plate (21) to be oriented toward an inner side of each web plate (21) from a top height of each web plate (21), wherein at least one of the plurality of the coupling bolts (24) is a through bolt (24') penetrating through the pair of web plates (21).

* * * * *